US008085223B2

(12) United States Patent
Nakai

(10) Patent No.: US 8,085,223 B2
(45) Date of Patent: Dec. 27, 2011

(54) IMAGE DISPLAY APPARATUS AND ITS DRIVING METHOD

(75) Inventor: Yutaka Nakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 654 days.

(21) Appl. No.: 12/188,640

(22) Filed: Aug. 8, 2008

(65) Prior Publication Data

US 2009/0058762 A1 Mar. 5, 2009

(30) Foreign Application Priority Data

Aug. 27, 2007 (JP) ..... 2007-219494

(51) Int. Cl.
*G09G 3/20* (2006.01)

(52) U.S. Cl. ..... 345/74.1; 345/55; 313/495

(58) Field of Classification Search ..... 345/30, 345/55, 60, 74.1, 75.2, 78, 208, 209, 211, 345/212, 213; 313/331, 495; 315/169.1, 315/169.3, 169.4
See application file for complete search history.

(56) References Cited

U.S. PATENT DOCUMENTS

| | | | | |
|---|---|---|---|---|
| 4,924,148 | A * | 5/1990 | Schwartz | 315/169.4 |
| 5,572,231 | A * | 11/1996 | Kobori | 345/75.2 |
| 5,838,288 | A * | 11/1998 | Lambert et al. | 345/74.1 |
| 5,894,293 | A * | 4/1999 | Hush et al. | 345/74.1 |
| 5,896,115 | A * | 4/1999 | Yano et al. | 345/74.1 |
| 6,380,914 | B1 * | 4/2002 | Xie | 345/75.2 |
| 6,746,884 | B2 * | 6/2004 | Suzuki | 438/20 |
| 6,822,397 | B2 * | 11/2004 | Kawasaki et al. | 315/169.2 |
| 6,995,734 | B2 * | 2/2006 | Moon | 345/55 |
| 7,250,926 | B2 * | 7/2007 | Suzuki et al. | 345/74.1 |
| 2002/0182761 | A1 * | 12/2002 | Suzuki | 438/20 |
| 2003/0090211 | A1 | 5/2003 | Komoda et al. | 315/169.1 |
| 2004/0145544 | A1 * | 7/2004 | Suzuki et al. | 345/75.2 |
| 2004/0201551 | A1 * | 10/2004 | Suzuki et al. | 345/55 |
| 2006/0001612 | A1 * | 1/2006 | Kim | 345/74.1 |
| 2006/0250345 | A1 | 11/2006 | Shino et al. | 345/100 |
| 2007/0035229 | A1 * | 2/2007 | Mikami et al. | 313/495 |

FOREIGN PATENT DOCUMENTS

| | | |
|---|---|---|
| JP | 2002-40986 | 2/2002 |
| JP | 2003-203589 | 7/2003 |
| JP | 2006-330701 | 12/2006 |

OTHER PUBLICATIONS

E. Yamaguchi et al., "A 10-in. Surface-conduction Electron-emitter Display", Journal of SID, vol. 5, No. 4, pp. 345-348 (1997).

* cited by examiner

*Primary Examiner* — Amare Mengistu
*Assistant Examiner* — Dmitriy Bolotin
(74) *Attorney, Agent, or Firm* — Fitzpatrick, Cella, Harper & Scinto

(57) ABSTRACT

A driving method of an image display apparatus includes the steps of: applying a non-selection potential to a first scanning wiring; and applying a selection potential to the first scanning wiring. A voltage applied to an electron-emitting device connected to the first scanning wiring is set to a voltage having a polarity reverse to that of a voltage to be applied upon emitting electrons during at least partial period of a period when the non-selection potential is applied to the first scanning wiring. The voltage applied to the electron-emitting device connected to the first scanning wiring is set to zero volt or to a voltage having a polarity same as that of the voltage to be applied upon emitting electrons and less than the threshold voltage, during a predetermined period before the selection potential is applied to the first scanning wiring.

9 Claims, 18 Drawing Sheets

IMAGE DISPLAY APPARATUS AND ITS DRIVING METHOD

BACKGROUND OF THE INVENTION

1. Field of the Invention

The present invention relates to a driving method of an image display apparatus using an electron-emitting device.

2. Description of the Related Art

As a large-screen thin-model display, attention has recently been paid on an image display apparatus with a phosphor excitation of electron beams emitted from an electron source, as is disclosed in "A 10-in. SCE emitter display", by E. Yamaguchi, et. Al., Journal of SID, Vol. 5, p 345, 1997. The electron beam excitable phosphor display apparatus described above has advantages such that an electron emitting array as a planar electron source can be formed by using a printing technique, a luminous principle same as that in a cathode-ray tube is used since a phosphor is excited to emit light by electrons, and a drive IC with low breakdown voltage can be used since a planar electron source can be driven with a voltage of ten odd volts.

FIG. 17 shows a configuration of an image display apparatus using a planar electron source. An electron-emitting device 12, which is a planar electron source, is formed on a rear plate 6. The electron-emitting device 12 is formed by arranging a conductive film 9 between electrodes 10 and 11. The electron-emitting device 12 is driven by a voltage applied between the electrodes 10 and 11. A microgap is formed on the conductive film 9. Phosphor films 4 of R, G, and B are applied for every pixel on a face plate 3 that is opposite to the rear plate 6. An anode electrode 5 made of aluminum is formed on the phosphor films 4. The portion between both plates 3 and 6 is kept to be vacuum. The electrons emitted from the electron-emitting device 12 are accelerated by the anode voltage to reach the phosphor films 4. The phosphor films 4 are excited to emit light by the energy of the accelerated electrons.

The principle of the luminescence itself of an image display apparatus using a planar electron source is the same as that of a cathode-ray tube. However, in a phosphor display apparatus using a planar electron source, the phosphor layer of the corresponding pixel is excited to emit light by the electrons emitted from the electron source provided for every pixel. The distance between the rear plate and the face plate is several millimeters, which means that the display apparatus is thin. These are great different points from the cathode-ray tube.

FIG. 18 is a plan view showing the configuration of the rear plate. The electron-emitting devices 12 are arranged in a matrix on a glass substrate. The electrode 10 is connected to a scanning wiring 7, while the electrode 11 is connected to a signal wiring 8. Although not shown, an insulating layer for insulating the scanning wiring 7 and the signal wiring 8 from each other is formed between both wirings. In the planar electron source array shown in FIG. 18, all of the conductive film 9, electrodes 10 and 11, scanning wirings 7, signal wirings 8, and insulating layer (not shown) can be formed by printing. Therefore, the formation of a device array on a substrate with large area is facilitated. Accordingly, the planar electron source array has a great prospect as the configuration of a large-screen flat display apparatus.

In FIG. 18, one or the plural scanning wirings 7 are selected by sequentially applying a selection pulse to the scanning wirings 7. On the other hand, drive pulses modulated according to an image signal are applied to each signal wiring 8. Thus, a drive voltage, which is a difference in potential between the selection pulse and the drive pulse, is applied to the electron-emitting device 12 connected to the selected scanning wiring 7. The amount of the electrons emitted from the electron-emitting device 12 can be controlled according to the amplitude and pulse width of the drive voltage. Accordingly, the required amount of electrons can be irradiated to a phosphor, whereby a desired image can be displayed.

The image display apparatus using the planar electron source described above has the features described below. Since the luminescence caused by exciting a phosphor with electron beams having high luminous efficiency is employed, the power consumption is small even if a large screen is used. Since the luminescence of the phosphor is kept in a very short period when the scanning wiring is selected, which means a hold-type display executed in a liquid crystal display (LCD) or a plasma display apparatus (PDP) is not executed, a very natural image can be displayed in displaying a moving image. Further, the image display apparatus described above has a wide viewing angle characteristic without having a viewing angle dependency of a screen brightness like an LCD. Since the planar electron source can be operated with ten-odd volts, it can be driven with a driver IC having low breakdown voltage.

FIG. 19 shows a voltage waveform applied to the electron-emitting device. In FIG. 19, numeral 1 denotes a waveform of a potential Vy of the scanning wiring, and numeral 2 denotes a waveform of a potential Vx of the signal wiring.

In order to drive electron-emitting devices in an optional one line in the matrix, a selection potential Vs is applied to the scanning wiring in the selected line, and at the same time, a non-selection potential Vns is applied to the scanning wirings in the non-selected lines. In synchronism with this, a drive potential Ve for outputting an electron beam is applied to the signal wiring. According to this method, the voltage (drive voltage) of Ve-Vs is applied to the electron-emitting devices in the selected line, while the voltage of Ve-Vns is applied to the electron sources in the non-selected lines. If Ve, Vs, and Vns are set to have a suitable magnitude, the electron beams having a desired intensity must be outputted only from the electron-emitting devices in the selected lines. Further, if the different drive potential Ve is applied to each signal wiring, the electron beam having a different intensity must be outputted from each of the electron-emitting devices in the selected line. Since the response speed of the electron-emitting device is high, the length of the time during when the electron beams are outputted must also be changed if the length of the time during when the drive potential Ve is applied is changed. In FIG. 19, the non-drive potential Vne of the signal wiring is defined as 0 V.

Japanese Patent Application Laid-Open (JP-A) No. 2002-40986 discloses a technique in which an offset voltage having a polarity reverse to that of a drive voltage is applied to an electron-emitting device in the non-selected state in order to reduce a reactive current of the electron-emitting device that is in the non-selected state. Specifically, as shown in FIG. 19, the scanning wiring potential Vy is set to the non-selection potential Vns ($0<Vns$) in the non-selected state. Since the signal wiring potential Vx becomes 0 V immediately after the selection of the preceding selection lines is completed, an inverse offset state is produced in the non-selected state as shown in FIG. 19. When the scanning wiring potential Vy becomes the selection potential Vs ($Vs<0$) by which the line is selected, the state of the applied voltage is changed from a reverse polarity to a positive polarity. Further, when the drive potential Ve according to the image signal is applied to the signal wiring, electrons are emitted from the electron-emitting device according to the potential difference (Ve−Vs)

between the signal wiring and the scanning wiring. Since the potential difference (Ve−Vns) between the signal wiring and the scanning wiring in the non-selected state is reduced, a leak current of the electron source can be reduced. As a result, the reactive current can be reduced.

JP-A No. 2006-330701 discloses a technique in which the transition between the selection potential and the non-selection potential is performed for 100 nsec to 2 μsec in order to suppress the overshoot and undershoot of the voltage waveform. JP-A No. 2006-330701 discloses a configuration in which the transition period from the selection to the non-selection in the nth line and the transition period from the non-selection to the selection in the (n+1)th line are overlapped with each other.

SUMMARY OF THE INVENTION

In the aforesaid image display apparatus, voltage is applied to the narrow gap formed on the electron-emitting device to generate a high electric field, and electrons are emitted by utilizing the high electric field. As the electric field is high, the emitted current increases, so that the applied voltage is desirably set as higher as possible. However, when the electron-emitting device repeats the selected state and the non-selected state, a discharge might rarely occur in the narrow gap of the electron source. The discharge entails a breakdown of the electron-emitting device, which causes a display defect. The breakdown of the electron-emitting device due to the discharge also induces the discharge between the electron source and an anode electrode, with the result that the anode electrode might also be damaged. If the discharge occurs, although the occurrence probability of the discharge is extremely low, the display defect is caused. Therefore, the discharge probability should further be reduced. The present invention aims to provide an image display apparatus that enhances a device withstand voltage, and its driving method.

The present invention provides a driving method of an image display apparatus comprising a plurality of electron-emitting devices, and a plurality of scanning wirings and a plurality of signal wirings that are connected to the plurality of electron-emitting devices in a matrix, wherein the electron-emitting devices emit electrons when a voltage applied to the electron-emitting device through the scanning wiring and the signal wiring becomes not less than a threshold voltage, the driving method comprising the steps of:

applying a non-selection potential to a first scanning wiring of the plurality of scanning wirings, and applying a selection potential to the first scanning wiring, wherein a voltage applied to the electron-emitting device connected to the first scanning wiring is set to a voltage having a polarity reverse to that of a voltage to be applied upon emitting electrons during at least partial period of a period when the non-selection potential is applied to the first scanning wiring, the voltage applied to the electron-emitting device connected to the first scanning wiring is set to zero volt or to a voltage having a polarity same as that of the voltage to be applied upon emitting electrons and less than the threshold voltage, during a predetermined period before the selection potential is applied to the first scanning wiring, wherein the predetermined period includes a period overlapped with the period during when the selection potential is applied to the second scanning wiring to which the selection potential is applied immediately before the first scanning wiring.

The present invention provides an image display apparatus according to the present invention comprising:

a plurality of electron-emitting devices;

a plurality of scanning wirings and a plurality of signal wirings connected to the plurality of electron-emitting devices in a matrix, and a drive circuit that controls potentials of the scanning wirings and the signal wirings, wherein the electron-emitting devices emit electrons when a voltage applied to the electron-emitting devices through the scanning wiring and the signal wiring becomes not less than a threshold voltage, the drive circuit applies a selection potential to a first scanning wiring of the plurality of scanning wirings after applying a non-selection potential to the first scanning wiring, the drive circuit sets the voltage applied to the electron-emitting device connected to the first scanning wiring to a voltage having a polarity reverse to that of a voltage to be applied upon emitting electrons, during at least partial period of a period when the non-selection potential is applied to the first scanning wiring, the drive circuit sets a voltage applied to the electron-emitting device connected to the first scanning wiring to zero volt or to a voltage having a polarity same as that of the voltage to be applied upon emitting electrons and less than the threshold voltage, during a predetermined period before the selection potential is applied to the first scanning wiring, wherein the predetermined period includes a period overlapped with the period during when the selection potential is applied to a second scanning wiring to which the selection potential is applied immediately before the first scanning wiring.

According to the present invention, a device withstand voltage can be enhanced.

Further features of the present invention will become apparent from the following description of exemplary embodiments with reference to the attached drawings.

BRIEF DESCRIPTION OF THE DRAWINGS

FIGS. 4A to 4D are views showing four conditions in which voltage states before a selection potential is applied are different, wherein FIG. 4A shows an inverse offset, FIG. 4B shows a zero offset, and FIGS. 4C and 4D show positive offsets;

DESCRIPTION OF THE EMBODIMENTS

A preferred embodiment of the present invention will illustratively be explained in detail with reference to the drawings.

(Configuration of Image Display Apparatus)

Figure 1:
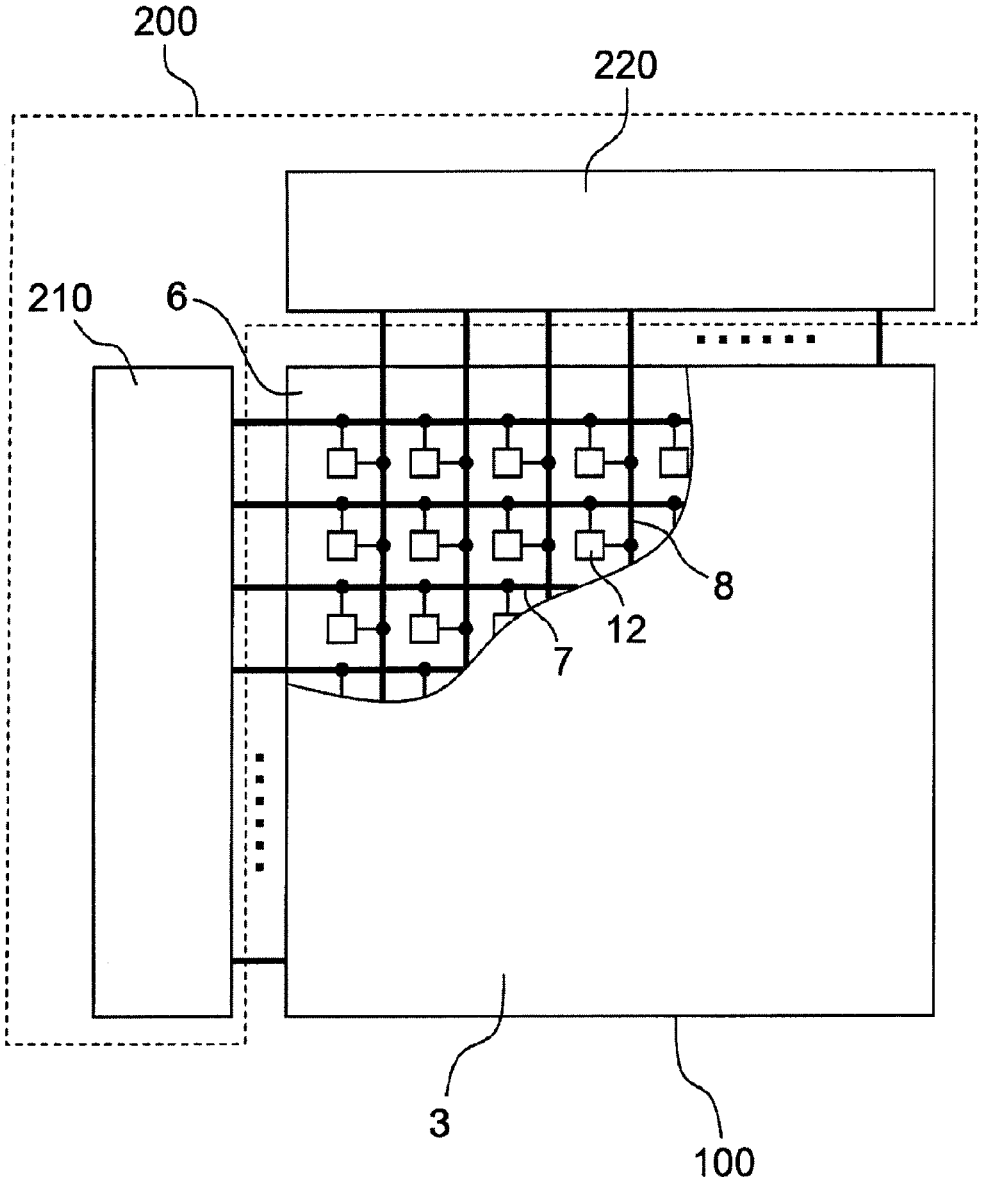
FIG. 1 is a plan view showing a configuration of an image display apparatus.

FIG. 1 schematically shows a configuration of an image display apparatus. The image display apparatus includes a display panel 100 and a drive circuit 200 for driving the display panel 100. The display panel 100 includes a rear plate 6 and a face plate 3 that is opposite to the rear plate 6. Plural scanning wirings 7 and plural signal wirings 8 are formed in a matrix on the rear plate 6, wherein electron-emitting devices 12 are formed at the intersections of the scanning wirings 7 and the signal wirings 8. This configuration is referred to as a simple matrix structure. A phosphor film and an anode electrode are formed on the face plate 3.

The drive circuit 200 includes a scanning circuit 210 electrically connected to the scanning wirings 7 and a modulation circuit 220 electrically connected to the signal wirings 8. The scanning circuit 210 is a circuit for controlling the potential of each scanning wiring 7. Basically, the scanning circuit 210 applies a selection potential Vs to the scanning wirings 7 to be selected, and applies non-selection potential Vns ($Vs<0<Vns$) to the scanning wirings 7 that are not selected. The modulation circuit 220 is a circuit for controlling the potential of each signal wiring 8. The modulation circuit 220 applies a pulse signal, which is modulated according to an image signal, to the signal wirings 8. The modulation technique includes a pulse width modulation, pulse amplitude modulation, or modulation of both of a pulse width and amplitude.

Figure 2:
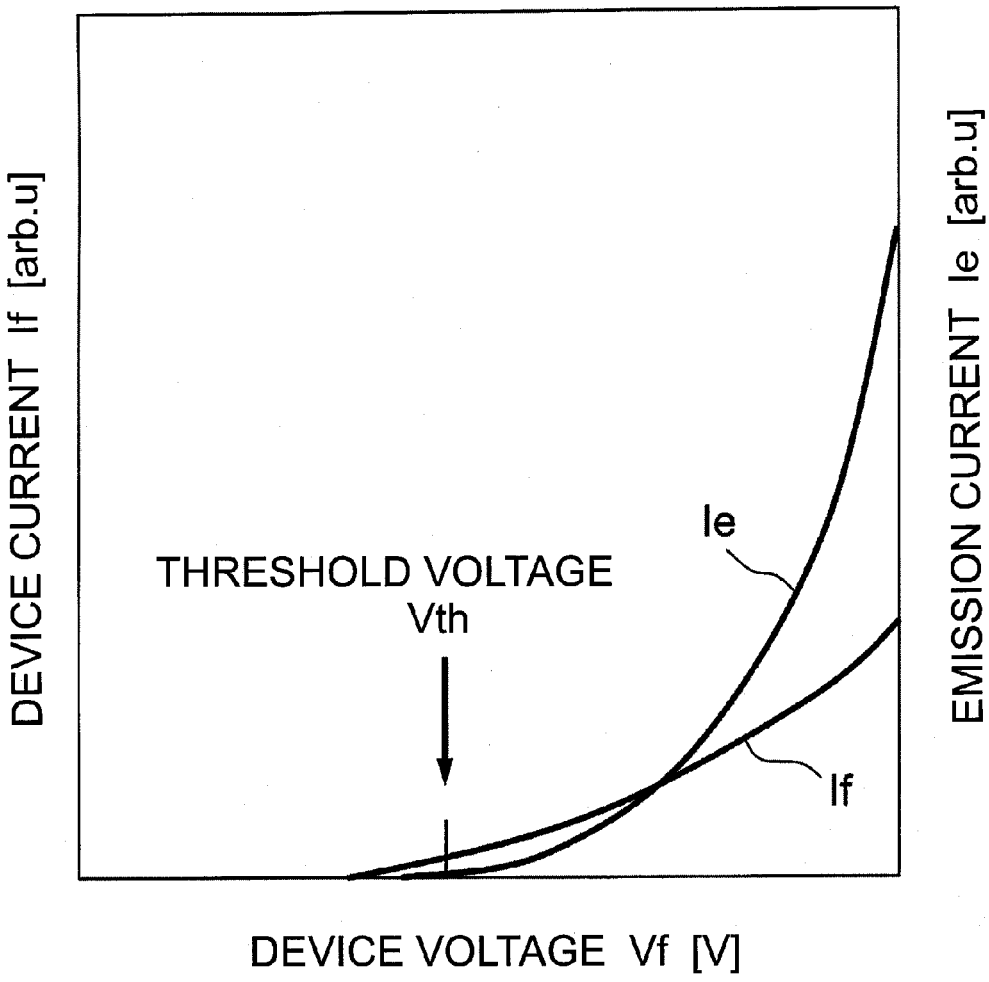
FIG. 2 is a view showing a characteristic of an electron-emitting device.

FIG. 2 shows a representative example of "emission current Ie"/"device voltage Vf" characteristic and "device current If"/"device voltage Vf" characteristic. The device voltage Vf is a voltage applied between the gate electrode and the cathode electrode of the electron-emitting device 12, the emission current Ie is an electric current flowing from the electron-emitting device 12 to the anode electrode, and the device current If is an electric current flowing between the gate electrode and the cathode electrode. The emission current Ie is remarkably smaller than the device current If, so that they are difficult to be illustrated with the same scale. Therefore, two graphs are respectively illustrated with an optional unit.

The electron-emitting device has a characteristic such that, when a voltage not less than a threshold voltage Vth is applied to the electron-emitting device, the device current Ie sharply increases, but the device current Ie is hardly detected with the voltage less than the threshold voltage Vth. The image display apparatus according to the present embodiment displays an image by utilizing this characteristic. Specifically, the voltage not less than the threshold voltage is applied, in accordance with the desired luminous brightness, to the electron-emitting device that is to be driven, while the voltage less than the threshold voltage is applied to the device that is not to be driven. Supposing that the device current Ie corresponding to the maximum luminous brightness (maximum gradation) is defined as a reference emission current, the voltage by which the device current Ie that is 1/100 of the reference emission current is detected may be set to the "threshold voltage Vth".

(Evaluation of Device Withstand Voltage)

Figure 3:
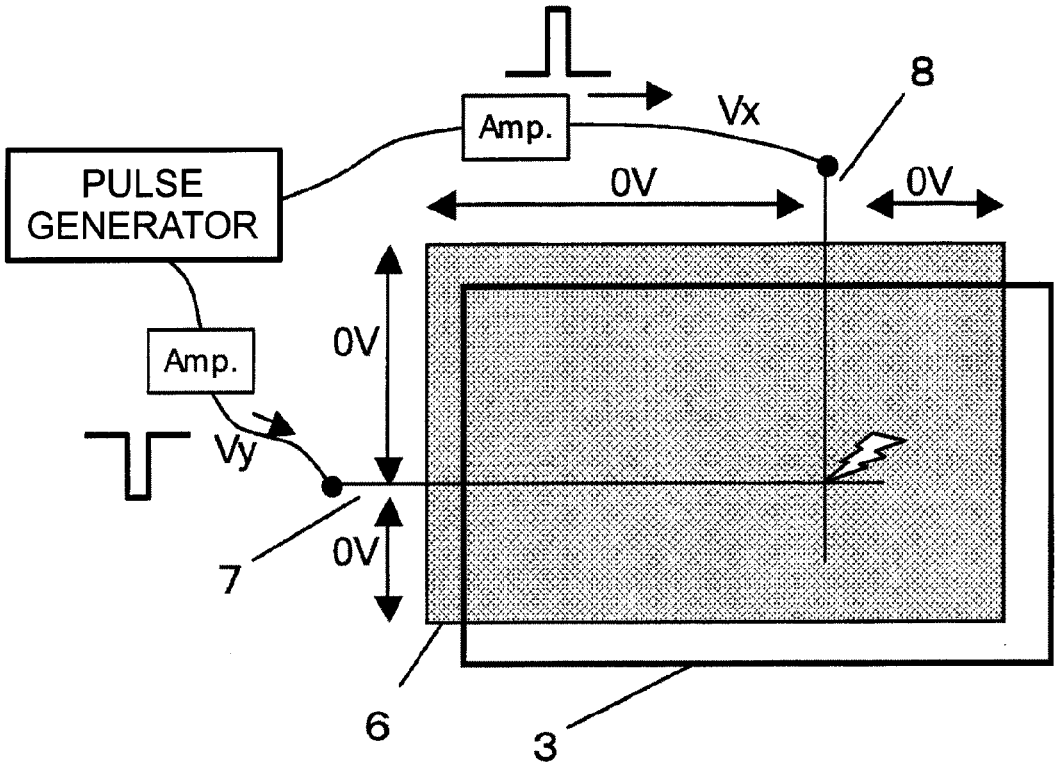
FIG. 3 is a view showing a method of an evaluation test of a device withstand voltage.
Figure 4A:
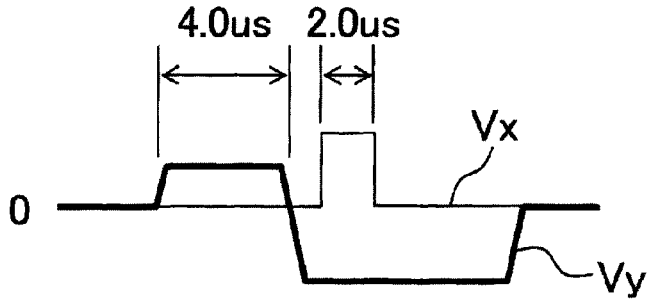
Figure 4B:
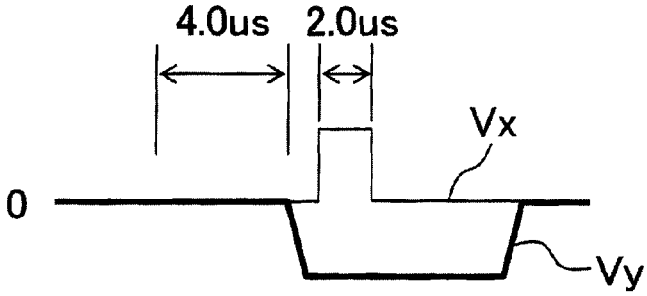
Figure 4C:
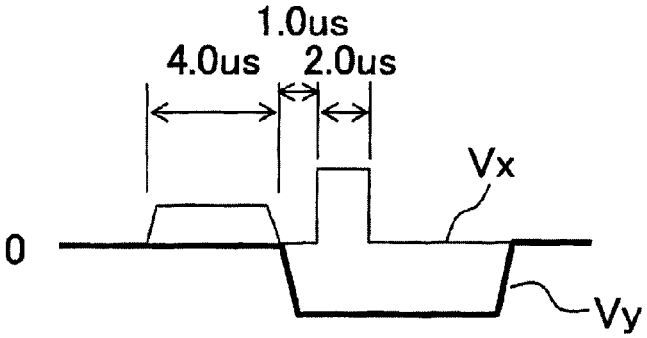
Figure 4D:
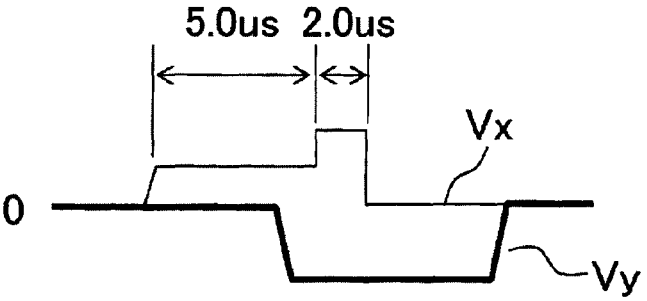

Firstly, a breakdown voltage evaluation test by an evaluation system shown in FIG. 3 is carried out in order to check the relationship between the voltage waveform applied to the electron-emitting device and the device withstand voltage.

Outputs of a pulse generator are connected to the specific scanning wiring 7 and the signal wiring 8. The potentials of the wirings other than the selected scanning wiring and the signal wiring are set to 0 V. An anode voltage is applied to the anode electrode. It is to be noted that the potential of the anode electrode may be set to 0 V.

The pulse generator repeatedly applies a pulse to the electron-emitting device at the intersection of the selected scanning wiring and the signal wiring. When the pulse generator gradually increases the amplitude (voltage value) of the pulse from a value smaller than the drive voltage, the device discharge is produced at a certain voltage. In case where the anode voltage is applied, the device discharge induces the discharge between the electron-emitting device and the anode electrode. The occurrence of the discharge can be detected by the change in the voltage of the scanning wiring or the signal wiring, or the change in the anode voltage or the anode current.

The voltage applied to the electron-emitting device when the discharge occurs is referred to as "device withstand voltage". It is considered that, as the device withstand voltage is high, the device discharge occurrence probability is low. As a result of examining the discharge occurrence frequency through the actual driving of the display apparatus, a clear correlation was established between the discharge occurrence frequency in the display state and the device withstand voltage obtained by the aforesaid test, whereby the effectiveness of the device withstand voltage evaluation test was exhibited.

Next, the comparison test of the device withstand voltage was carried out for four conditions in FIGS. 4A to 4D in which the voltage states before the selection potential was applied were different from one another. The unit "us" in the figure means "μsec (microsecond)". In the condition shown in FIG. 4A, an inverse offset state of about 4.0 μsec is set before the selection potential was applied to the scanning wiring. In the condition shown in FIG. 4B, a zero offset state of about 4.0 μsec is set before the selection potential was applied to the scanning wiring. In the condition shown in FIG. 4C, a normal offset state of about 4.0 μsec is set before the selection potential is applied to the scanning wiring. In the condition shown in FIG. 4D, a normal offset state of about 5.0 μsec was set before the selection potential was applied to the scanning wiring. In FIGS. 4A to 4D, the scanning wiring potential Vy and the signal wiring potential Vx were set to 0 V before the inverse offset state, zero offset state or normal offset state.

Here, the voltage having the polarity reverse to that of the voltage applied upon emitting the electrons (upon the driving) is referred to as "inverse offset voltage", and the state in which the inverse offset voltage is applied to the electron-emitting device is referred to as "inverse offset state" or "inverse offset". In other words, the inverse offset state is the state in which the relationship of the magnitude of the scanning wiring potential Vy and the signal wiring potential Vx becomes reverse to that upon emitting the electrons (upon the driving). The "zero offset" means that the voltage is substantially not applied to the electron-emitting device, i.e., the scanning wiring potential Vy and the signal wiring potential Vx are substantially equal to each other. The voltage having the polarity same as that of the voltage applied upon emitting the electrons is referred to as "normal offset voltage". The state in which the normal offset voltage is applied to the electron-emitting device is referred to as "normal offset" or "normal offset state". In other words, the normal offset state means that the relationship of the magnitude of the scanning wiring potential Vy and the signal wiring potential Vx becomes equal to that upon emitting the electrons.

Figure 5:
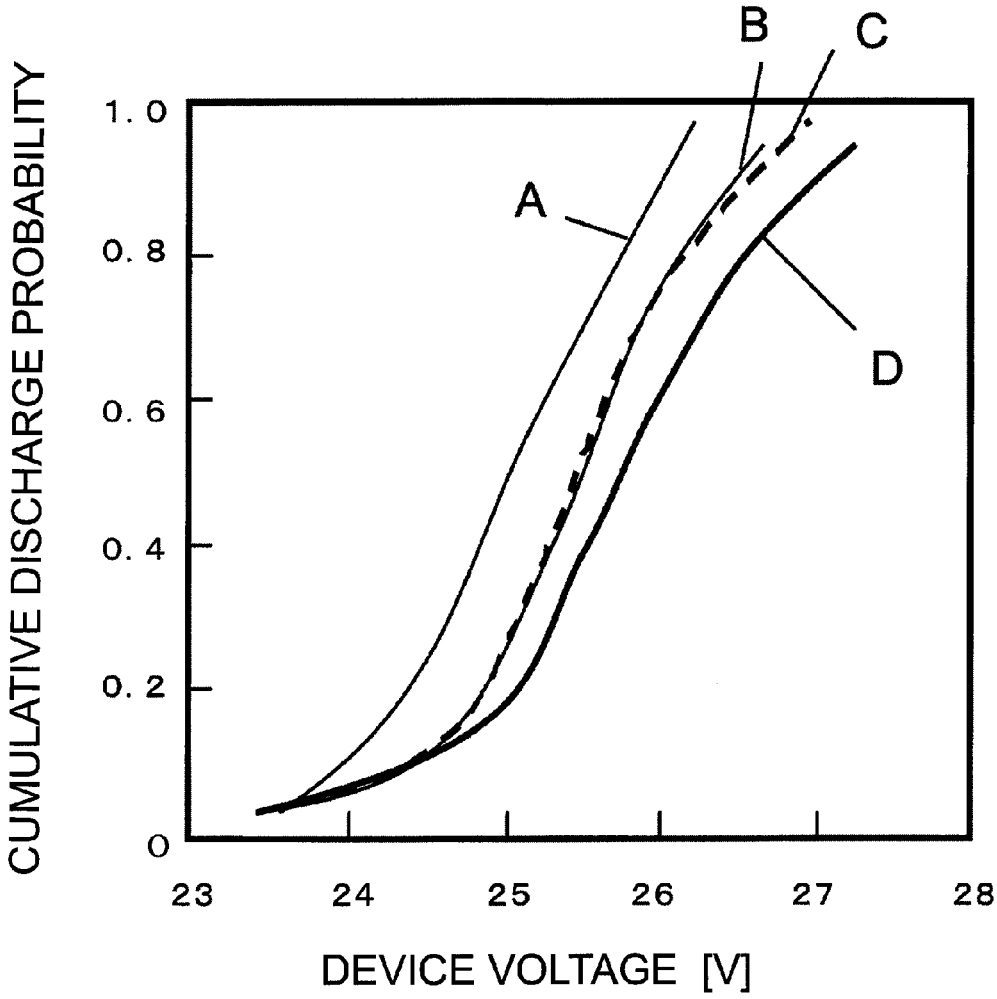
FIG. 5 is a graph showing the result of a comparison test of four conditions in FIGS. 4A to 4D.
Figure 6A:
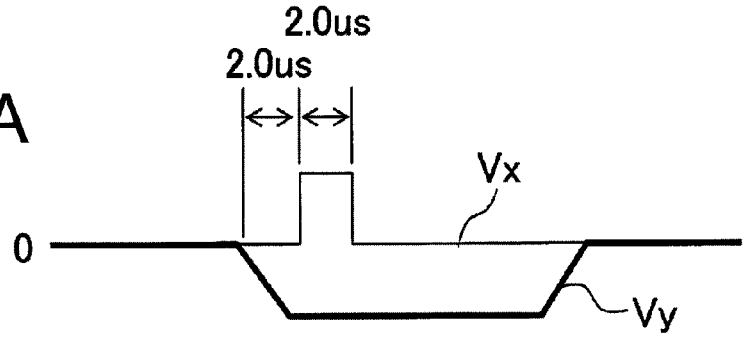
FIGS. 6A to 6D are views showing four conditions, in which the length of the positive offset period is different.
Figure 6B:
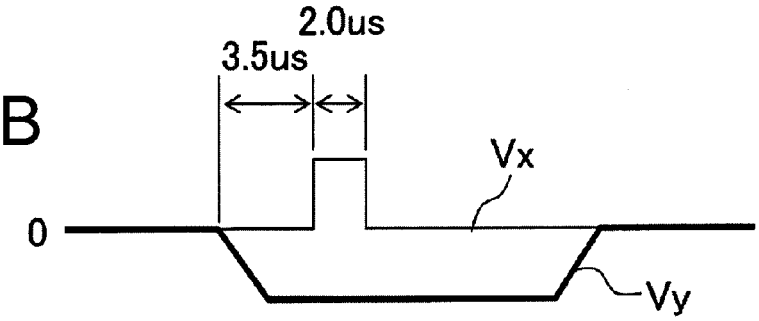
Figure 6C:
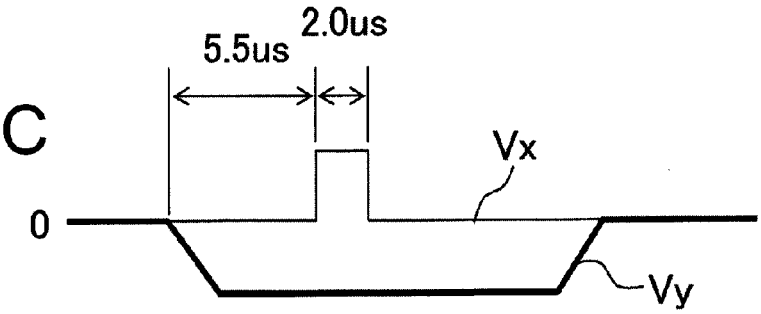
Figure 6D:
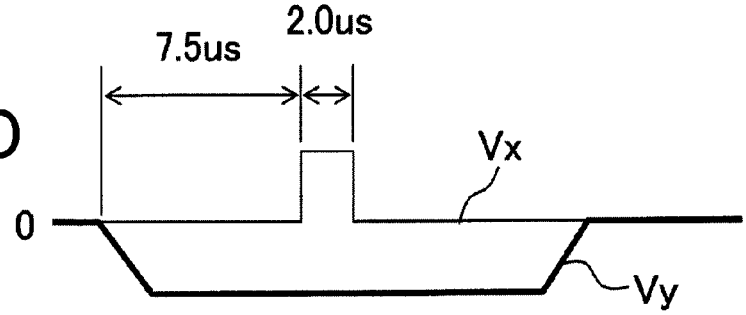

FIG. 5 shows the result of the comparison test of four conditions in FIGS. 4A to 4D. The abscissa axis indicates the amplitude of the pulse applied to the electron-emitting device (device voltage) [V], while ordinate axis indicates the ratio (probability) of the (cumulative) number of the devices, with respect to the total number of the devices, to which the discharge occurs by the time the pulse with this amplitude is applied. The device withstand voltage was the lowest in the case of the inverse offset in FIG. 4A, and the device withstand voltage of the same level was obtained in the case of the zero offset in FIG. 4B and the normal offset in FIG. 4C. The highest device withstand voltage was obtained in the case of the condition in FIG. 4D in which the period of the normal offset was long.

Next, in order to examine the correlation between the length of the period of the normal offset and the device withstand voltage, the comparison test of the device withstand voltage was carried out for four conditions in FIGS. 6A to 6D in which the lengths of the normal offset periods were different from one another. In the condition in FIG. 6A, the normal offset period of 2.0 μsec is set. Here, the normal offset state was created by setting the scanning wiring potential Vy to the selection potential, and the signal wiring potential Vx to 0 V. Before the normal offset state, the scanning wiring potential Vy and the signal wiring potential Vx were set to 0 V respectively. Similarly, the normal offset period of 3.5 μsec, the normal offset period of 5.5 μsec, and the normal offset period of 7.5 μsec are respectively set in the condition in FIG. 6B, in the condition in FIG. 6C, and in the condition in FIG. 6D.

Figure 7:
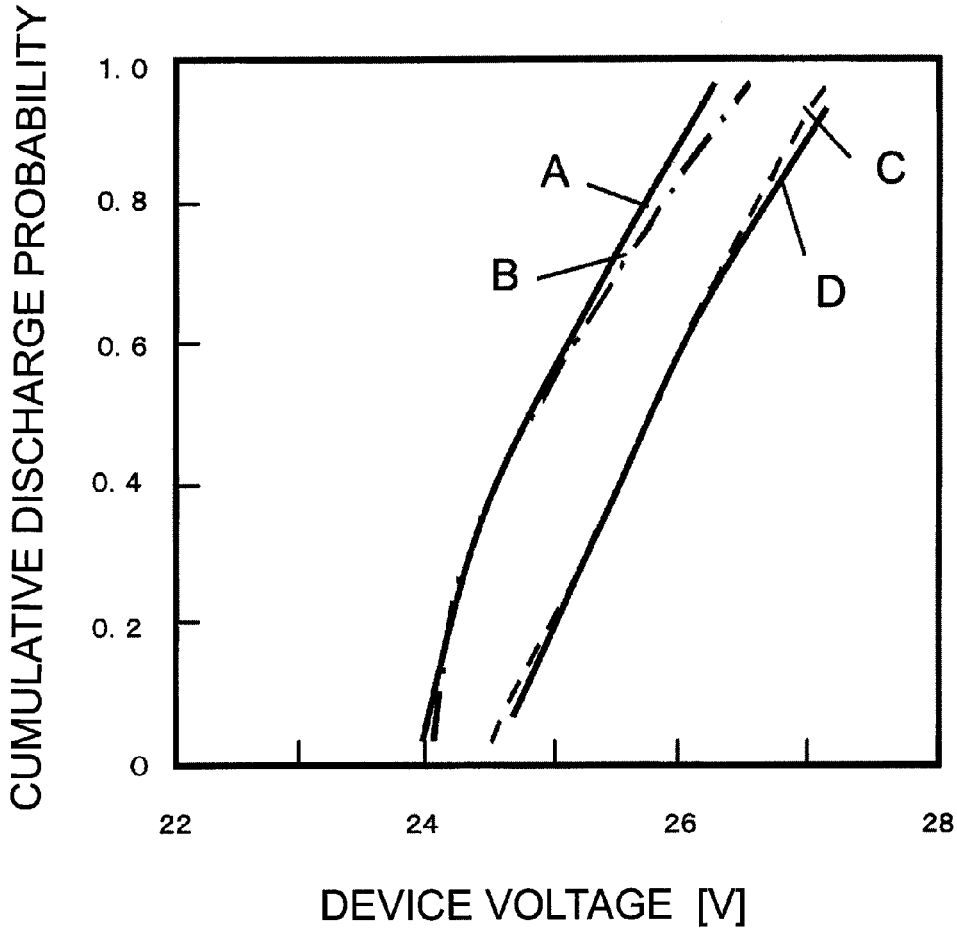
FIG. 7 is a graph showing the result of a comparison test of four conditions in FIGS. 6A to 6D.

FIG. 7 shows the result of the comparison test for four conditions in FIGS. 6A to 6D. The abscissa axis and the ordinate axis are the same as those in the graph of FIG. 5. As shown in FIG. 7, there is a tendency that, the longer the normal offset period is set, the higher the device withstand voltage becomes.

The following findings are brought by the test described above. Specifically, (1) the device withstand voltage is decreased if the inverse offset state is set immediately before the selected state (the state in which the selection potential is applied to the scanning wiring), (2) the device withstand voltage increases if the zero offset state or the normal offset state is set immediately before the selected state, and (3) the device withstand voltage can further be enhanced by increasing the normal offset period immediately before the selected state. It is found that the length of the normal offset period is preferably not less than 2.0 μsec, and more preferably not less than 4.0 μsec.

The specific driving method of the image display apparatus will be explained below.

(Driving Method 1)

Figure 8:
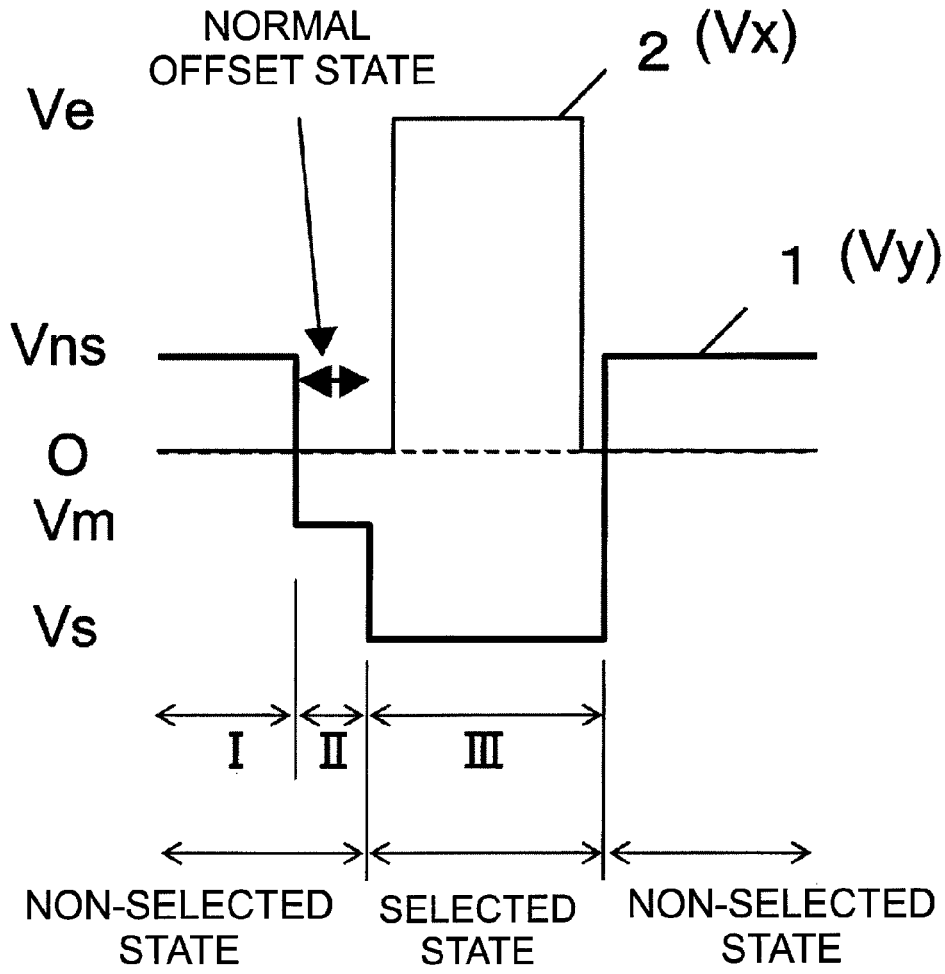
FIG. 8 is a view showing a voltage waveform in a driving method 1.

FIG. 8 is an example of a voltage waveform in a driving method 1. In the driving method 1, the voltage applied to the electron-emitting device connected to the scanning wiring is set to the fixed normal offset voltage less than the threshold voltage during a fixed period before the selection potential Vs is applied to the scanning wiring (first scanning wiring) to be driven.

Specifically, in the driving method 1, a first period (I) during when the non-selection potential Vns is applied to the scanning wiring, a second period (II) during when the offset potential Vm is applied to the scanning wiring, and a third period (III) during when the selection potential Vs is applied to the scanning wiring are provided ($Vs<Vm<0<Vns$; $0-Vm<Vth$). Here, the third period is the selected state, and the first and second periods other than the third period are the non-selected state. The reference potential of the signal wiring is 0 V, and when the electron-emitting device is driven, the drive potential Ve is applied to the signal wiring during the third period ($0<Ve$; $Vth \leqq Ve-Vs$).

The electron-emitting device is kept to be in the inverse offset state during the first period. Accordingly, the leak current from the device in the non-selected state can be prevented. The electron-emitting device is in the normal offset state during the second period. Here, the length of the second period is set to 5.0 μsec. By setting the normal offset immediately before the selected state (third period) as described above, the device withstand voltage can be more increased than a conventional one, whereby the occurrence of the discharge can be prevented. Since the length of the second period is extremely shorter than the length of the first period, the increase in the leak current from the device (reactive current) caused by the normal offset is not a problem.

(Driving Method 2)

Figure 9:
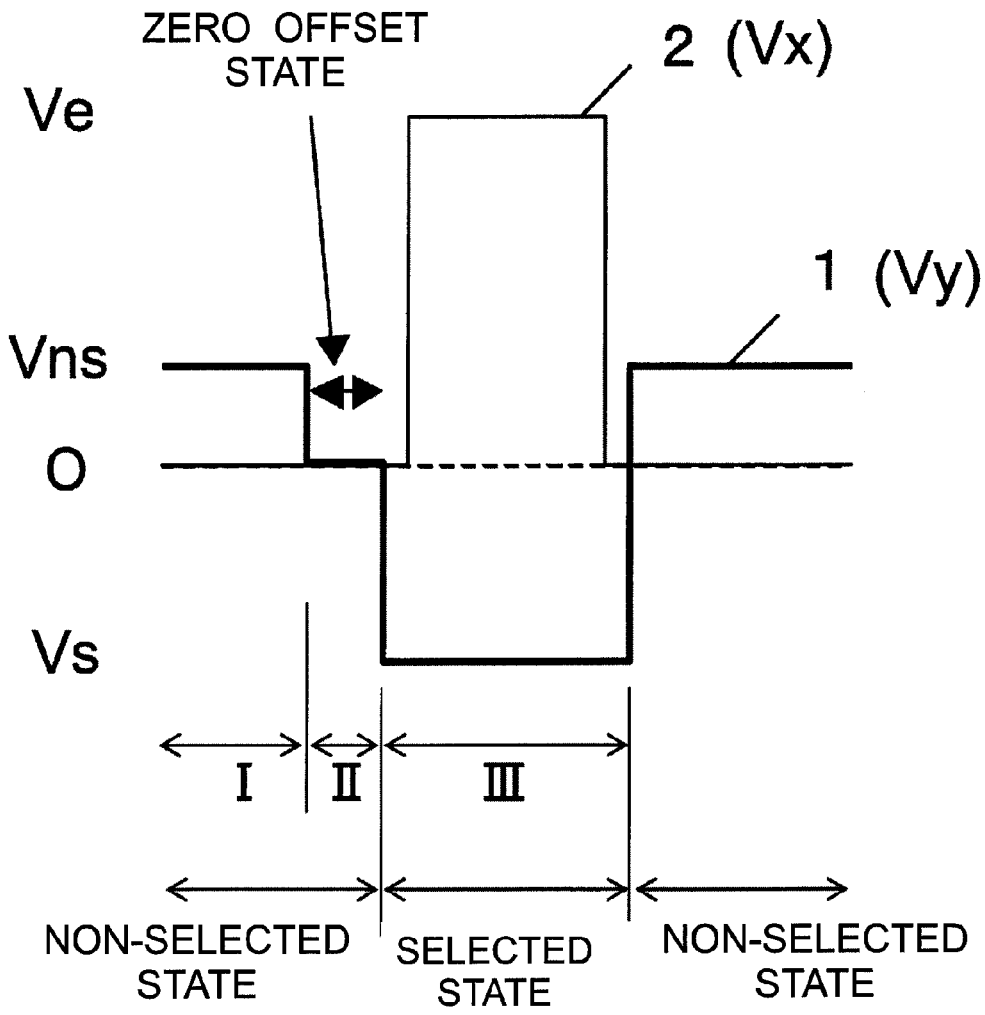
FIG. 9 is a view showing a voltage waveform in a driving method 2.

FIG. 9 is an example of a voltage waveform in the driving method 2. In the driving method 2, the voltage applied to the electron-emitting device connected to the scanning wiring is set to 0 volt during a fixed period before the selection potential Vs is applied to the scanning wiring.

Specifically, in the driving method 2, a first period (I) during when the non-selection potential Vns is applied to the scanning wiring, a second period (II) during when the potential of the scanning wiring is set to 0 V, and a third period (III) during when the selection potential Vs is applied to the scanning wiring are set ($Vs<0<Vns$). Here, the third period is the selected state, and the first and second periods other than the third period are the non-selected state. The reference potential of the signal wiring is 0 V, and when the electron-emitting device is driven, the drive potential Ve is applied to the signal wiring during the third period ($0<Ve$; $Vth \leqq Ve-Vs$).

The electron-emitting device becomes the zero offset state during the second period. Here, the length of the second period is set to 5.0 μsec. By setting the zero offset immediately before the selected state (third period) as described above, the device withstand voltage can be more increased than a conventional one, whereby the occurrence of the discharge can be prevented. Since the length of the second period is extremely shorter than the length of the first period, the increase in the leak current from the device (reactive current) caused by the zero offset is not a problem.

(Driving Method 3)

Figure 10:
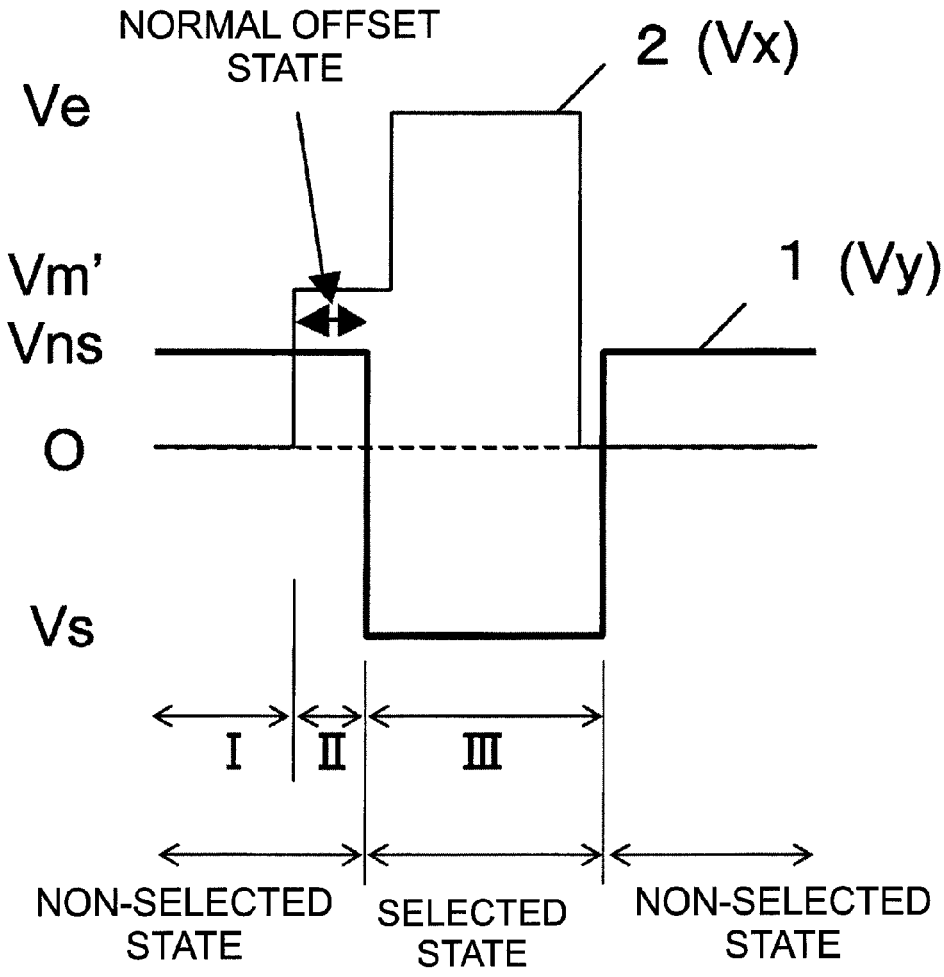
FIG. 10 is a view showing a voltage waveform in a driving method 3.

FIG. 10 is an example of a voltage waveform in the driving method 3. In the driving method 3, the voltage applied to the electron-emitting device connected to the scanning wiring is set to the normal offset voltage less than the threshold voltage during a fixed period before the selection potential Vs is applied to the scanning wiring, like the driving method 1. It is to be noted that the normal offset is realized by controlling the signal wiring potential Vx in the driving method 3, although in the driving method 1, the normal offset is realized by controlling the scanning wiring potential Vy.

Specifically, in the driving method 3, a first period (I) during when the non-selection potential Vns is applied to the scanning wiring and the potential of the signal wiring is set to 0 V, a second period (II) during when the offset potential Vm' is applied to the signal wiring with the non-selection potential Vns applied to the scanning wiring, and a third period (III)

during when the selection potential Vs is applied to the scanning wiring are provided (Vs<0<Vns; 0<Vm'<Ve; Vm'−Vns<Vth). Here, the third period is the selected state, and the first and second periods other than the third period are the non-selected state. When the electron-emitting device is driven, the drive potential Ve is applied to the signal wiring during the third period (0<Ve; Vth≦Ve−Vs). In the driving method 3, some period of the period during when the non-selection potential Vns is applied to the scanning wiring is set to the inverse offset.

The operation and effect same as those in the driving method 1 can be obtained by the driving method 3. Although the description of the specific example is omitted, the operation and effect same as those in the driving method 1 can be obtained by the method in which both of the scanning wiring potential Vy and the signal wiring potential Vx are controlled to realize the normal offset.

The selected state in the present invention means the state in which the selection potential Vs is applied to the scanning wiring. The non-selected state in the present invention means the state in which the selection potential Vs is not applied to the scanning wiring. Specifically, the non-selected state does not always coincide with the state in which the non-selection potential Vns is applied to the scanning wiring, as is apparent from FIG. 8 or FIG. 9.

(Driving Method 4)

In the above-mentioned driving methods 1 to 3, the zero offset or the normal offset is set in a very short period immediately before the selected state of the scanning wiring. However, the number of the scanning wirings is great in a high definition image display apparatus, so that the selected period (horizontal scanning period) of each scanning wiring is short. Therefore, it may be difficult to newly set the period for setting the zero offset or the normal offset immediately before the selected state of the scanning wiring.

Figure 11:
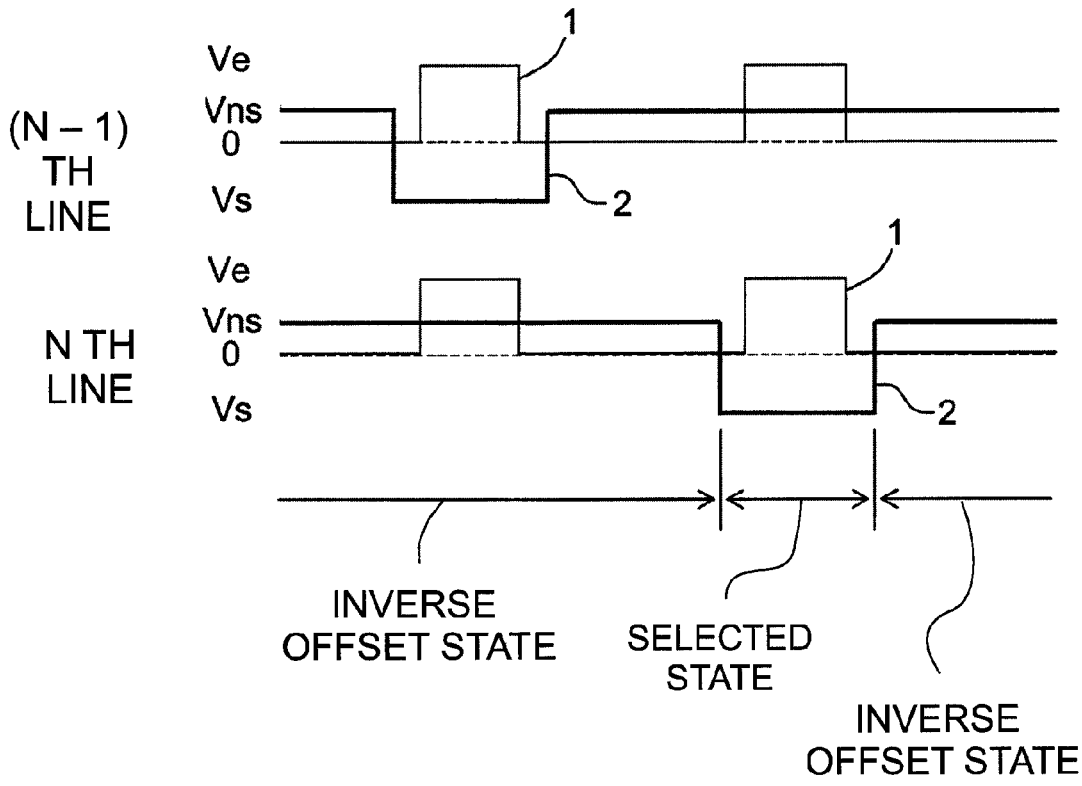
FIG. 11 is a view showing a voltage waveform in a conventional driving method.

The technique for solving this problem will be explained with reference to FIGS. 11 and 12. FIG. 11 is a conventional voltage waveform, while FIG. 12 is a voltage waveform in the driving method 4.

FIG. 11 shows the Nth line (the Nth selected scanning wiring) (first scanning wiring) and the (N−1)th line (second scanning wiring) to which the selection potential Vs is applied immediately before the Nth line, among the plural scanning wirings sequentially scanned. The electron-emitting device connected to the Nth line is kept to be in the inverse offset state immediately before it is brought into the selected state.

Figure 12:
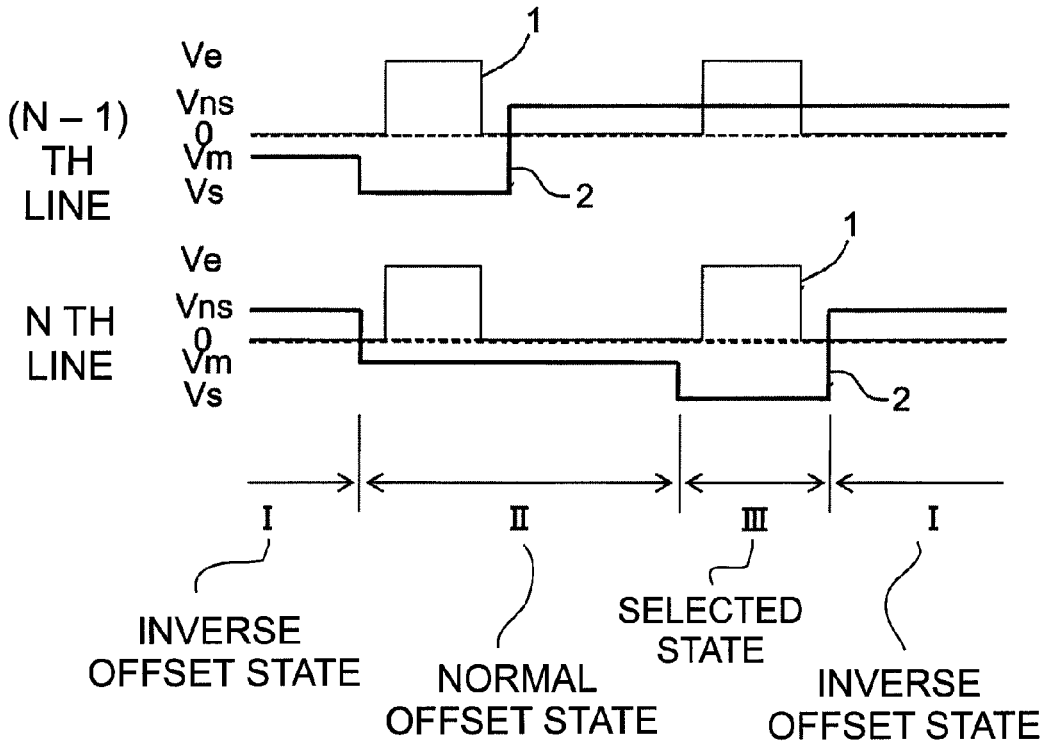
FIG. 12 is a view showing a voltage waveform in a driving method 4.

On the other hand, in the driving method 4, the normal offset period of the Nth line includes the period that is overlapped with the period during when the selection potential Vs is applied to the (N−1)th line as shown in FIG. 12. Specifically, the application of the offset potential Vm to the Nth line is started when the selection potential Vs is applied to the (N−1)th line. Accordingly, the normal offset period having a sufficient length can be secured, even if the selection period of each scanning wiring is short. Similarly, the period of the zero offset can be secured.

The timing for starting the application of the offset potential Vm is not limited to the one shown in FIG. 12. The normal offset of the Nth line may be started before the selection potential Vs is applied to the (N−1)th line. Specifically, the normal offset period of the Nth line may be overlapped with the selection period of the (N−2)th line or the scanning wiring before the (N−2)th line.

Example 1

FIG. 1 is a view showing a configuration of an image display apparatus according to the Example 1.

Plural scanning wirings 7 are formed in the horizontal direction and plural signal wirings 8 are formed in the vertical direction on the rear plate 6 made of a glass substrate. The number of the scanning wirings 7 is 480, and the number of the signal wirings 8 is 1920. The wiring pitches of the scanning wirings 7 and the signal wirings 8 are respectively 720 μm and 240 μm. The electron-emitting device 12 (here, the surface conduction electron-emitting device) that is a planar electron source is provided at each intersection of the scanning wiring 7 and the signal wiring 8.

Figure 17:
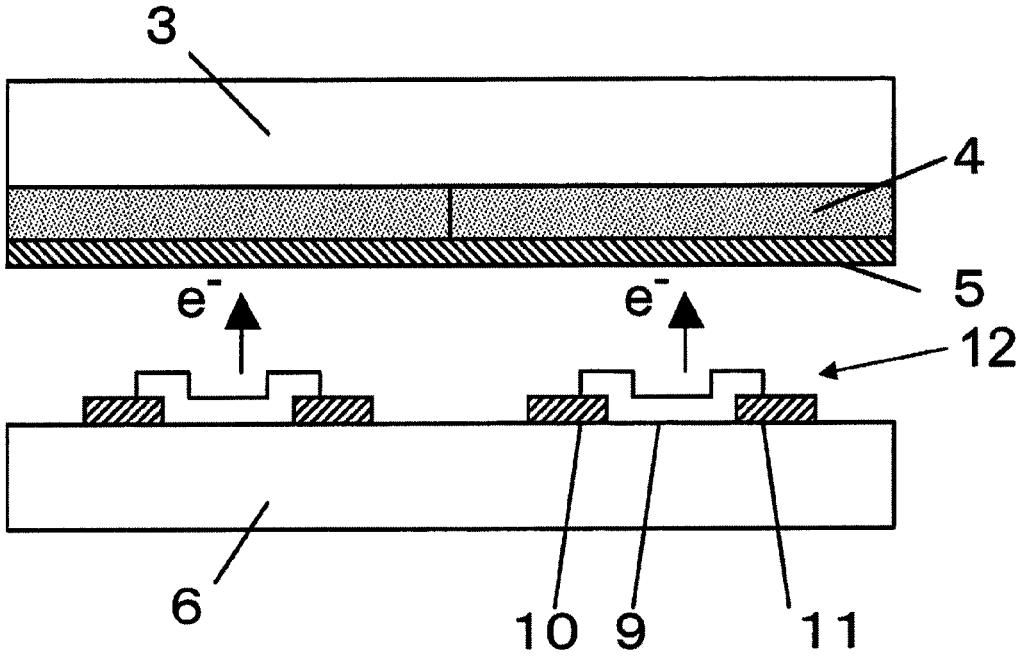
FIG. 17 is a sectional view showing the configuration of an image display apparatus.
Figure 18:
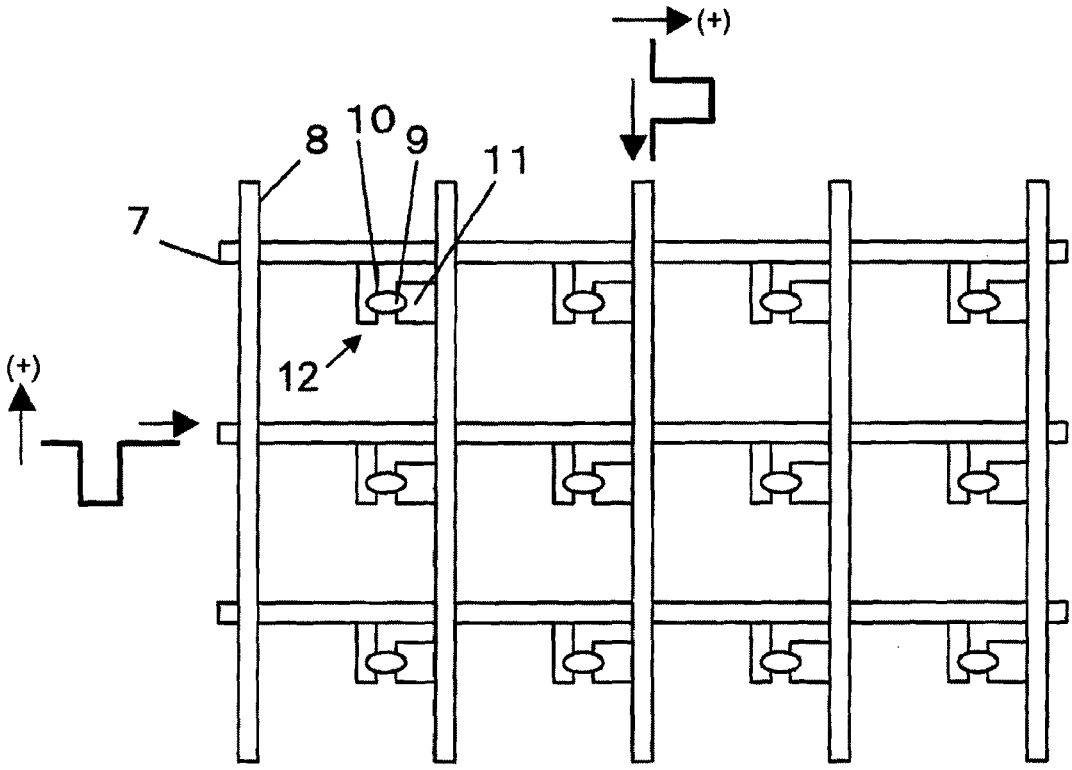
FIG. 18 is a plan view showing a configuration of a rear plate.

The face plate 3 is made of a glass substrate. The phosphor films 4 of R, G and B are formed on the inner face of the face plate 3 as shown in FIG. 17. Each of the phosphor films 4 is formed with a pitch corresponding to each electron-emitting device 12 on the rear plate 6. An anode electrode 5 made of a thin aluminum layer is formed on the phosphor films 4. The anode voltage Va that accelerates the electrons is applied to the anode electrode 5 upon the display operation.

The rear plate 6 and the face plate 3 are respectively bonded to a support frame (not shown) with a frit glass or the like. A gap of several millimeters is formed between the rear plate 6 and the face plate 3. A plate-like or columnar spacer may be provided between both plates in order to keep the gap between the rear plate 6 and the face plate 3.

After both plates are sealed, inside of the display cell is evacuated through an exhaust pipe mounted at the outside of the display region. Thereafter, the drive circuit 200 is connected to each wiring, whereby the image display apparatus is completed.

Figure 14:
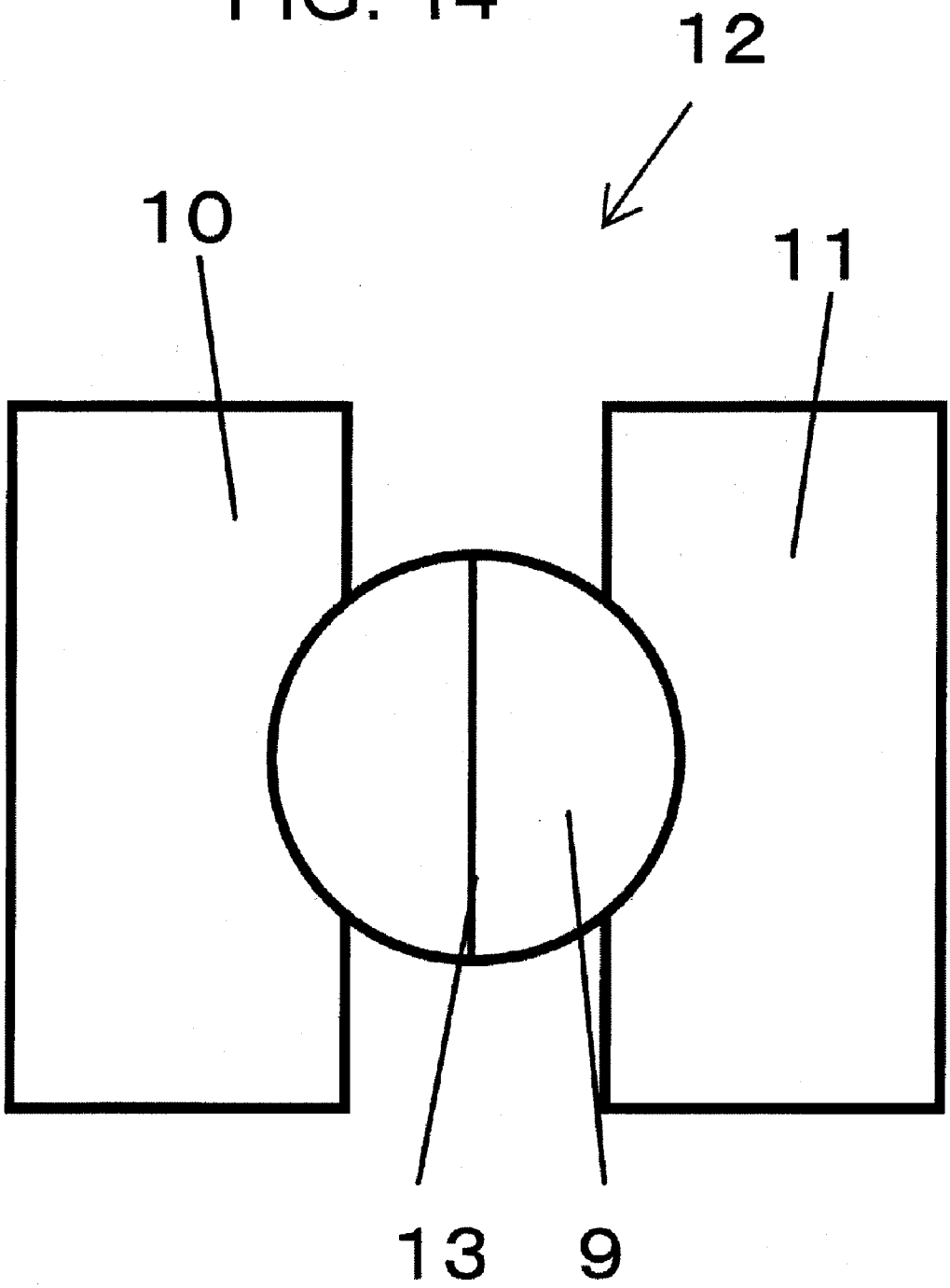
FIG. 14 is a plan view showing a configuration of a surface conduction electron-emitting device.

FIG. 14 is a plan view showing the configuration of the electron-emitting device (surface conduction electron-emitting device) used in the present Example.

A conductive film 9 is formed from fine grains of PdO between the thin-film electrodes 10 and 11 made of Pt or the like by an ink jet printing. A gap (crack) 13 can be formed on the conductive film 9 by performing an appropriate energizing process between the electrodes 10 and 11. The width of this gap 13 is not more than submicron. Therefore, when a voltage is applied between both electrodes 10 and 11 after the gap is formed, a strong electric field sufficient for emitting electrons is generated at the gap 13.

The electron emitting capability of the electron-emitting device 12 is substantially in proportion to the length of the gap 13. In the present Example, the length of the gap 13 is set to 100 μm. The forming condition of the gap 13 is a pulse voltage with 100 V, a pulse width of 1 msec, and period of 10 msec. The similar energizing process may be performed in the organic gas atmosphere or in the vacuum after the gap 13 is formed, in order to make the characteristic of the electron-emitting device uniform.

In the present Example, the voltage waveform applied to the electron-emitting device 12 was as shown in FIG. 8. In the case of the driving of 60 Hz, 34.7 μsec was allocated to one line. 5 μsec of 34.7 μsec was allocated to the normal offset state and 20 μsec of 34.7 μsec was allocated to the selected state, whereby the electron emitting time sufficient for the display could be secured.

Figure 19:
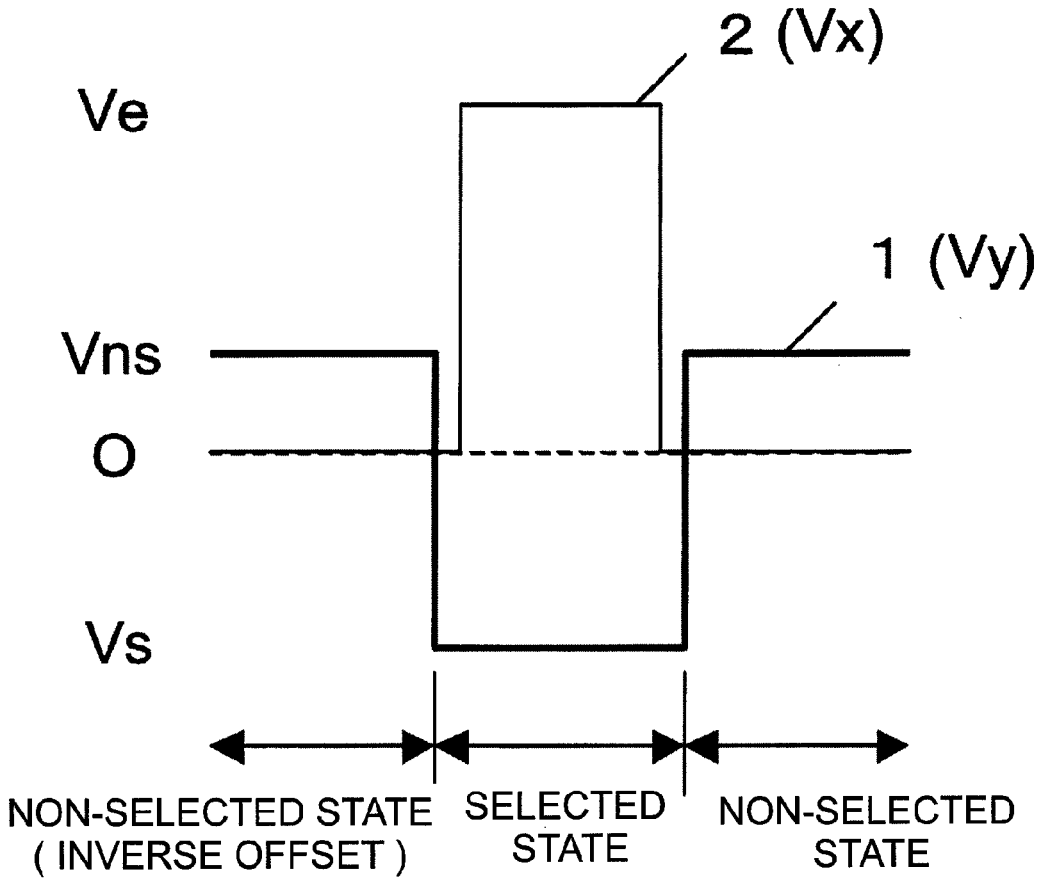
FIG. 19 is a view showing one example of a conventional driving method.

In the present Example, the selection potential of the scanning wiring was set to −10 V, the non-selection potential Vns was set to +4 V, the scanning wiring potential Vm in the normal offset state was set to −4 V, the drive potential Ve of the signal wiring was set to 10 V, and the anode voltage Va was set to 10 kV, and the continuous totally white color display test for 10000 hours was carried out. For comparison, a totally white color display test by a conventional driving method was also carried out by using the voltage waveform shown in FIG. 19. As a result, 1.5 average device discharges was observed during display test for 10000 hours by the conventional driving method, while the device discharge was not observed during the display test for 10000 hours according to the present Example.

Example 2

The configuration of the image display apparatus in the Example 2 is the same as that in the Example 1, except that the number of the scanning wirings 7 is 1080, the number of the signal wirings 8 is 5940, and the wiring pitches of the scanning wirings 7 and the signal wirings 8 are respectively 720 μm and 240 μm.

In the present Example, the voltage waveform applied to the electron source was as shown in FIG. 12. In the case of the driving of 60 Hz, 15.4 μsec was allocated to one line. 10 μsec of 15.4 μsec was allocated to the selected state. The selected state is shorter than that in the Example 1. Since there has been no room for inserting the normal offset state, the method of starting the application of the normal offset voltage during when the previous line is in the selected state was adopted as shown in FIG. 12. As a result, 15 μsec that was substantially the same as the period for selecting one line could be secured as the normal offset state.

In the present Example, the selection potential Vs of the scanning wiring was set to −10 V, the non-selection potential Vns was set to +4 V, the scanning wiring potential Vm in the normal offset state was set to −4 V, the drive potential Ve of the signal wiring was set to 10 V, and the anode voltage Va was set to 10 kV, and the continuous totally white color display test for 10000 hours was carried out. For comparison, a totally white color display test by a conventional driving method shown in FIG. 19 was also carried out. As a result, 1.5 average device discharges was observed during display test for 10000 hours by the conventional driving method, while the device discharge was not observed during the display test for 10000 hours according to the present Example.

Figure 15:
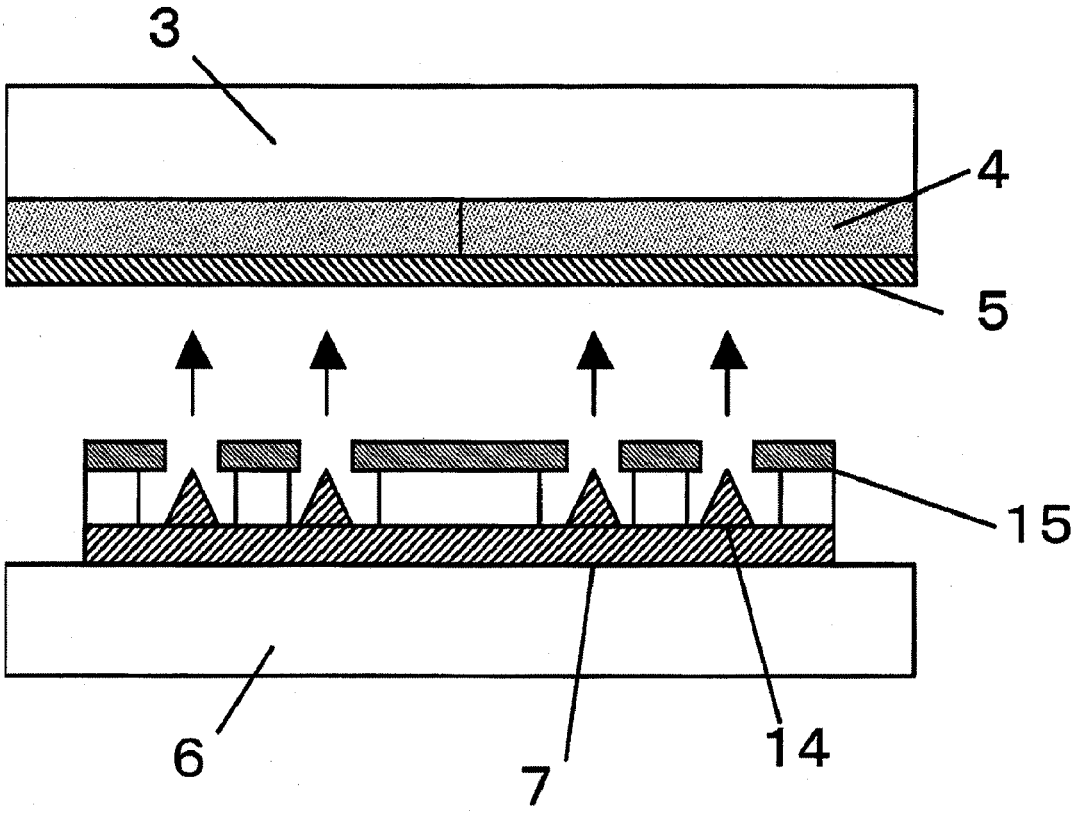
FIG. 15 is a sectional view showing a modification of the image display apparatus.
Figure 16:
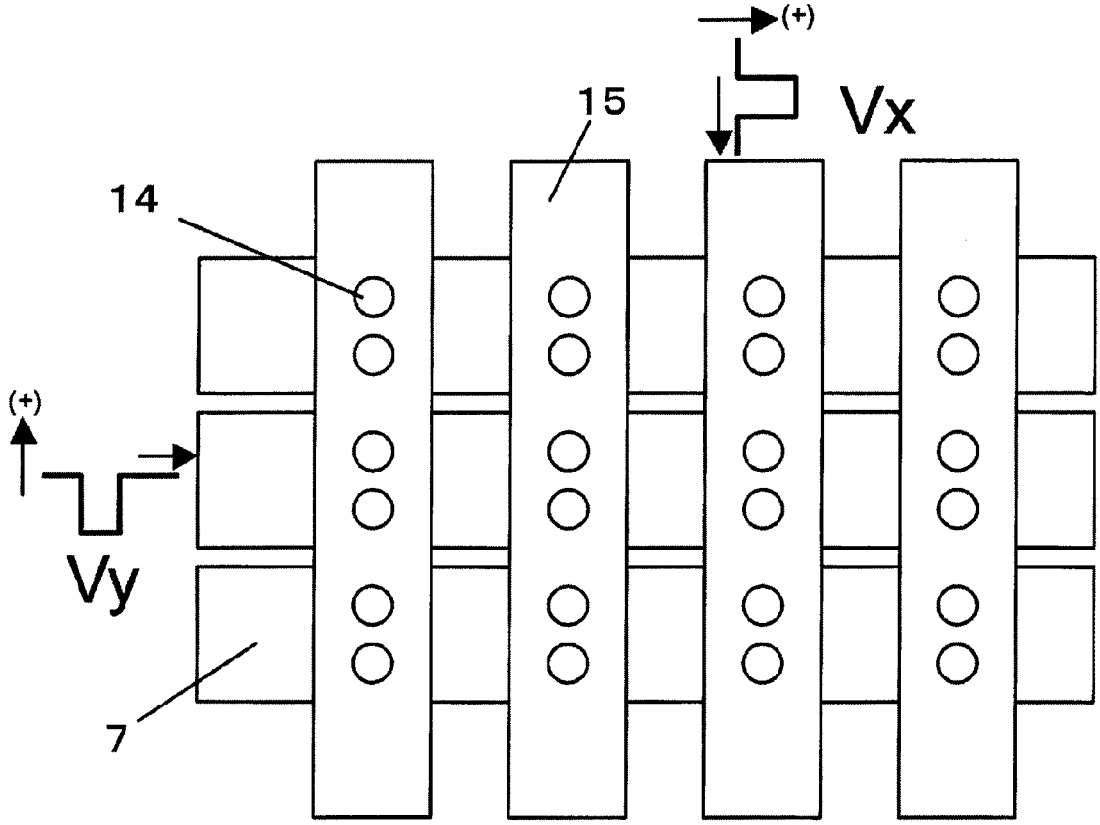
FIG. 16 is a plan view showing a configuration of a rear plate of the image display apparatus shown in FIG. 15.

In the Examples described above, the surface conduction electron-emitting device shown in FIG. 14 was used, but the present invention was not limited thereto. For example, a sharpened electron source shown in FIGS. 15 and 16 may be employed. When the scanning wiring potential Vy is applied to a sharpened emitter 14 and the signal wiring potential Vx is applied to a gate 15, a discharge might occur between the sharpened emitter 14 and the gate 15, but the frequency of the discharge can be reduced by the application of the present invention.

An MIM electron-emitting device or ballistic electron-emitting device may be employed. Further, various modifications are applicable without departing from the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-219494, filed on Aug. 27, 2007, which is hereby incorporated by reference herein its entirety.

What is claimed is:

1. A driving method of an image display apparatus comprising a plurality of electron-emitting devices, and a plurality of scanning wirings and a plurality of signal wirings that are connected to the plurality of electron-emitting devices in a matrix form, wherein the electron-emitting device emits electrons when a voltage applied to the electron-emitting device through the scanning wiring and the signal wiring becomes not less than a threshold voltage, the driving method comprising the steps of:

applying a non-selection potential to a first scanning wiring of the plurality of scanning wirings, and applying a selection potential to the first scanning wiring, wherein a voltage applied to the electron-emitting device connected to the first scanning wiring is set to a voltage having a polarity reverse to that of a voltage to be applied upon emitting electrons during at least partial period of a period when the non-selection potential is applied to the first scanning wiring, the voltage applied to the electron-emitting device connected to the first scanning wiring is set to zero volt or to a voltage having a polarity same as that of the voltage to be applied upon emitting electrons and less than the threshold voltage, during a predetermined period before the selection potential is applied to the first scanning wiring, wherein the predetermined period commences before the time when the selection potential is applied to a second scanning wiring to which the selection potential is to be applied immediately before the time when the selection potential is applied to the first scanning wiring.

2. A driving method of an image display apparatus according to claim 1, wherein the voltage having the reverse polarity is a voltage less than the threshold voltage.

3. A driving method of an image display apparatus according to claim 1, wherein a potential between the selection potential and the non-selection potential is applied to the first scanning wiring during the predetermined period.

4. A driving method of an image display apparatus according to claim 1, wherein the electron-emitting device is a surface conduction electron-emitting device.

5. A driving method of an image display apparatus comprising a plurality of surface conduction electron-emitting devices, and a plurality of scanning wirings and a plurality of signal wirings that are connected to the plurality of surface conduction electron-emitting devices in a matrix form, wherein the surface conduction electron-emitting device emits electrons when a voltage applied to the surface conduction electron-emitting device through the scanning wiring and the signal wiring becomes not less than a threshold voltage, the driving method comprising the steps of:

applying a non-selection potential to a first scanning wiring of the plurality of scanning wirings, and applying a selection potential to the first scanning wiring, wherein a voltage applied to the surface conduction electron-emitting device connected to the first scanning wiring is set to a voltage having a polarity reverse to that of a voltage to be applied upon emitting electrons during at least partial period of a period when the non-selection potential is applied to the first scanning wiring, and the voltage applied to the surface conduction electron-emitting device connected to the first scanning wiring is set to zero volt or to a voltage having a polarity same as that of the voltage to be applied upon emitting electrons and less than the threshold voltage, during a predetermined period before the selection potential is applied to the first scanning wiring, wherein the predetermined period commences before the time when selection potential is applied to a second scanning wiring to which the selection potential is to be applied immediately before the time when selection potential is applied to the first scanning wiring.

6. An image display apparatus comprising:

a plurality of electron-emitting devices;

a plurality of scanning wirings and a plurality of signal wirings connected to the plurality of electron-emitting devices in a matrix form, and a drive circuit that controls potentials of the scanning wirings and the signal wirings, wherein the electron-emitting device emits electrons when a voltage applied to the electron-emitting device through the scanning wiring and the signal wiring becomes not less than a threshold voltage, the drive circuit applies a selection potential to a first scanning wiring of the plurality of scanning wirings after applying a non-selection potential to the first scanning wiring, the drive circuit sets a voltage applied to the electron-emitting device connected to the first scanning wiring to a voltage having a polarity reverse to that of a voltage to be applied upon emitting electrons, during at least partial period of a period when the non-selection potential is applied to the first scanning wiring, the drive circuit sets the voltage applied to the electron-emitting device connected to the first scanning wiring to zero volt or to a voltage having a polarity same as that of the voltage to be applied upon emitting electrons and less than the threshold voltage, during a predetermined period before the selection potential is applied to the first scanning wiring, wherein the predetermined period commences before the time when the selection potential is applied to a second scanning wiring to which the selection potential is to be applied immediately before the time when the selection potential is applied to the first scanning wiring.

7. An image display apparatus according to claim 6, wherein the voltage having the reverse polarity is a voltage less than the threshold voltage.

8. An image display apparatus according to claim 6, wherein a potential between the selection potential and the non-selection potential is applied to the first scanning wiring during the predetermined period.

9. An image display apparatus according to claim 6, wherein the electron-emitting device is a surface conduction electron-emitting device.

* * * * *